US010647504B2

(12) United States Patent
Kanczuzewski et al.

(10) Patent No.: US 10,647,504 B2
(45) Date of Patent: May 12, 2020

(54) CARGO RESTRAINT ASSEMBLY

(71) Applicant: LOGISTICK, INC., South Bend, IN (US)

(72) Inventors: Nicholas Kanczuzewski, Mishawaka, IN (US); John E. Townsend, Paw Paw, IN (US)

(73) Assignee: LOGISTICK, INC., South Bend, IN (US)

( * ) Notice: Subject to any disclaimer, the term of this patent is extended or adjusted under 35 U.S.C. 154(b) by 0 days.

(21) Appl. No.: 15/995,488

(22) Filed: Jun. 1, 2018

(65) Prior Publication Data

US 2019/0367267 A1 Dec. 5, 2019

(51) Int. Cl.
*B65D 90/00* (2006.01)
*B65D 88/12* (2006.01)

(52) U.S. Cl.
CPC ..... *B65D 90/0053* (2013.01); *B65D 88/121* (2013.01); *B65D 2590/0041* (2013.01)

(58) Field of Classification Search
CPC ..... B65D 90/0053; B65D 2519/00298; B65D 2519/00338; B65D 2519/00532; B65D 2519/00626
USPC ..... 410/149, 35, 122, 127, 128, 130, 87, 7, 410/44; 248/354.1, 122.1, 125.2, 157, 248/503, 251
See application file for complete search history.

(56) References Cited

U.S. PATENT DOCUMENTS 969,002 A 8/1910 Teachout
1,238,874 A 9/1917 Biela
1,401,419 A 12/1921 Mcnally
1,951,660 A 3/1934 Klaudt
2,124,082 A 7/1938 Reifer
2,414,160 A 1/1947 Moon
2,464,080 A 3/1949 Hankins
2,467,681 A 4/1949 McKinney
2,468,101 A 4/1949 Nampa
2,468,104 A 4/1949 Phillips
2,697,631 A 12/1954 Miller
2,752,864 A 7/1956 McDougal, Sr. et al.
2,766,704 A 10/1956 McMahon
2,845,245 A 5/1958 Gray et al.
2,905,107 A 9/1959 Nichol
2,912,939 A 11/1959 Miner, Jr. et al.
2,980,037 A 4/1961 Elsner
2,993,708 A 7/1961 Holman, Jr.
3,075,478 A 1/1963 Elsner
3,090,600 A 5/1963 Smith
3,177,007 A 4/1965 Oren
3,344,750 A 10/1967 Kostrewa
3,367,286 A 2/1968 Jantzen
3,559,591 A 2/1971 Breen et al.
3,590,746 A 7/1971 Gibson
3,712,663 A 1/1973 Laven
(Continued)

FOREIGN PATENT DOCUMENTS

GB 1209255 10/1970

*Primary Examiner* — D Glenn Dayoan
*Assistant Examiner* — Sunsurraye Westbrook
(74) *Attorney, Agent, or Firm* — Barnes & Thornburg LLP

(57) ABSTRACT

An assembly for engaging an elongate support for restraining cargo in a container having a wall including a base strip securable to the wall having a longitudinal axis and including a top surface having a pair of slide rails, and a sleeve defining a cavity for receiving an end of the elongated support.

19 Claims, 13 Drawing Sheets

(56) References Cited

U.S. PATENT DOCUMENTS

D232,821 S 9/1974 Fry
3,836,174 A 9/1974 Holman, Jr.
3,995,565 A 12/1976 Kersey
4,026,508 A 5/1977 Ziegler
4,080,906 A 3/1978 Brown
D248,228 S 6/1978 Robertson
4,264,251 A 4/1981 Blatt
4,278,376 A 7/1981 Hunter
4,396,325 A 8/1983 Joice-Cavanagh
4,432,678 A 2/1984 Liebel
4,473,225 A 9/1984 Miller
4,498,824 A 2/1985 Kinkle
4,616,757 A 10/1986 Hobson
4,700,918 A 10/1987 Andrasko, Jr.
4,718,584 A 1/1988 Schoeny
D294,340 S 2/1988 Robson
4,735,468 A 4/1988 Taylor, Jr. et al.
4,756,498 A 7/1988 Frye
4,801,228 A 1/1989 Van Gompel
4,830,558 A 5/1989 Sweeney
4,846,610 A 7/1989 Schoenleben
4,880,342 A 11/1989 Pradovic
4,932,817 A 6/1990 Mattare
4,955,771 A 9/1990 Bott
4,962,907 A 10/1990 Gary
D312,604 S 12/1990 Barnes et al.
4,982,922 A 1/1991 Krause
5,028,184 A 7/1991 Krause
5,037,256 A 8/1991 Schroeder
D324,303 S 3/1992 Miller
5,156,110 A 10/1992 Fuller
5,161,700 A 11/1992 Stannis et al.
5,169,007 A 12/1992 McHendry
D332,242 S 1/1993 Graehling
5,219,251 A 6/1993 Kanczuzewski
D339,682 S 9/1993 Phelps
5,259,712 A 11/1993 Wayne
5,281,063 A 1/1994 Austin, III
D344,482 S 2/1994 Arvidsson
D347,419 S 5/1994 Jackson
5,320,464 A 6/1994 Long et al.
5,326,204 A 7/1994 Carlson et al.
5,362,184 A 11/1994 Hull et al.
5,370,482 A 12/1994 Long
5,392,972 A 2/1995 Caruso et al.
D358,125 S 5/1995 Jackson
5,494,389 A 2/1996 Kanczuzewski
5,526,972 A 6/1996 Frazier et al.
D372,016 S 7/1996 Wolford
D373,754 S 9/1996 Pinterpe
D376,578 S 12/1996 Redford
5,636,951 A 6/1997 Long et al.
D382,533 S 8/1997 Okland
5,688,087 A 11/1997 Stapleton et al.
D392,246 S 3/1998 Anderson
D395,998 S 7/1998 Ballinger
D397,322 S 8/1998 Tobin
5,807,047 A 9/1998 Cox
D406,095 S 2/1999 Denny et al.
D412,151 S 7/1999 Ferrigan
D422,554 S 4/2000 Stapleton et al.
6,068,228 A 5/2000 Kobayashi et al.
D426,512 S 6/2000 Ciuba
6,074,143 A 6/2000 Langston et al.
6,086,299 A 7/2000 Kanczuzewski
6,106,205 A 8/2000 Haire
D434,369 S 11/2000 Matthies
D438,022 S 2/2001 Bunn
D450,291 S 11/2001 Wang
D453,869 S 2/2002 Schultz et al.
D458,210 S 6/2002 Kanczuzewski et al.
6,419,434 B1 7/2002 Rahn
6,431,804 B1 8/2002 Wetzig, III
D462,310 S 9/2002 Kanczuzewski et al.
6,454,501 B1 9/2002 Parker
6,533,513 B2 3/2003 Kanczuzewski et al.
6,572,063 B1 6/2003 Gitelman et al.
D478,857 S 8/2003 Petersen et al.
6,607,338 B2 8/2003 Lemke
6,851,652 B1 2/2005 Huang
6,874,982 B2 4/2005 Rhodes
D506,076 S 6/2005 Weisgerber
6,942,004 B2 9/2005 Whittemore
7,037,055 B1 5/2006 Rogers et al.
7,134,820 B2 11/2006 Ehrlich
D537,405 S 2/2007 Saward
7,334,973 B2 2/2008 Scott
7,356,888 B2 4/2008 Chao et al.
D571,279 S 6/2008 Trusty et al.
D589,709 S 4/2009 Edwards
7,628,572 B2 12/2009 Kanczuzewski et al.
7,713,008 B2 5/2010 Kanczuzewski et al.
7,785,051 B2 8/2010 Kanczuzewski et al.
7,785,052 B2 8/2010 Kanczuzewski et al.
7,817,922 B2 10/2010 Cho et al.
D633,030 S 2/2011 Robertson
D638,345 S 5/2011 Kanczuzewski et al.
8,172,494 B1 5/2012 Knox
8,192,121 B1 6/2012 Kanczuzewski et al.
8,425,166 B2 4/2013 Kanczuzewski et al.
8,545,150 B2 10/2013 Kanczuzewski et al.
8,545,151 B2 10/2013 Kanczuzewski et al.
8,550,758 B2 10/2013 Kanczuzewski et al.
8,696,273 B1 4/2014 Kanczuzewski et al.
D722,004 S 2/2015 Kanczuzewski et al.
9,234,537 B2 1/2016 Huang
D756,291 S 5/2016 Masanek, Jr.
9,550,446 B1 1/2017 Kanczuzewski et al.
9,764,679 B2 9/2017 Kanczuzewski et al.
9,821,701 B2 11/2017 Kanczuzewski et al.
2002/0071733 A1 6/2002 Parker
2002/0176759 A1* 11/2002 Kanczuzewski ..... B60P 7/15 410/152
2004/0156692 A1 8/2004 Rhodes
2007/0224010 A1* 9/2007 Cunningham ..... B60P 7/0815 410/143
2008/0152455 A1* 6/2008 Kanczuzewski ..... B60P 7/15 410/152
2010/0111636 A1 5/2010 Widynowski
2010/0308091 A1 12/2010 Hubbard
2011/0068137 A1 3/2011 Murray et al.
2015/0158411 A1* 6/2015 Pakulak ..... B60P 7/0807 410/143
2019/0366907 A1 12/2019 Kanczuzewski
2019/0367266 A1 12/2019 Kanczuzewski

* cited by examiner

CARGO RESTRAINT ASSEMBLY

The present disclosure relates to an assembly for restraining cargo within a container.

BACKGROUND

Cargo transported for commercial and other uses is often shipped in semi-trailers or other trucks, railcars, ships, aircraft or other containers. In most instances, shifting or translation of cargo within the container can occur during shipping which can lead to damage. It is known to secure a pair of cargo retention devices on opposed walls of the shipping container, and an elongate support in the form of a wood beam or the like is positioned across the bed of the shipping vehicle and engaged with the cargo retention devices to secure cargo.

SUMMARY

The present disclosure relates to an assembly for engaging an elongate support for restraining cargo in a container having a wall. The assembly comprises a base strip securable to the wall having a longitudinal axis and including a top surface having first engaging structure extending along the longitudinal axis. The assembly also comprises a sleeve defining a cavity for receiving an end of the elongaged support, and including a top defining an opening of the cavity and a bottom including second engaging structure removably engageable with the first engaging structure for removably engaging the sleeve and the base strip.

The first engaging structure may comprise at least one slide rail extending along the longitudinal axis and the second engaging structure defines a slot for slidingly engaging the slide rail. The first engaging structure may include a stop adjacent the slide rail for limiting movement of the sleeve in a longitudinal direction along the longitudinal axis of the base strip. The first engaging structure may include another slide rail and the two slide rails may be spaced and interconnected by ribs. The base strip may include a pair of lips extending from the stop and the bottom of the sleeve may define a pair of channels for slidably engaging the pair of lips. The sleeve may include a wall defining an opening and the stop may include a stabilizer receivable by the opening to removably engage the sleeve and the stop. The sleeve may include a pair of opposed walls, each defining a pair of openings, so that the stabilizers are selectively receivable by either of the pairs of openings.

The base strip may include a first lateral edge adjacent the first slide rail and a second lateral edge adjacent the second slide rail, the first slide rail extending from the top surface at an angle towards the first lateral edge and the second slide rail extending from the top surface at an angle towards the second lateral edge. The slot may be a dovetail slot that slidingly engages the first and second slide rails. The leading ends of the slide rails may be tapered.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

DETAILED DESCRIPTION

Figure 1:
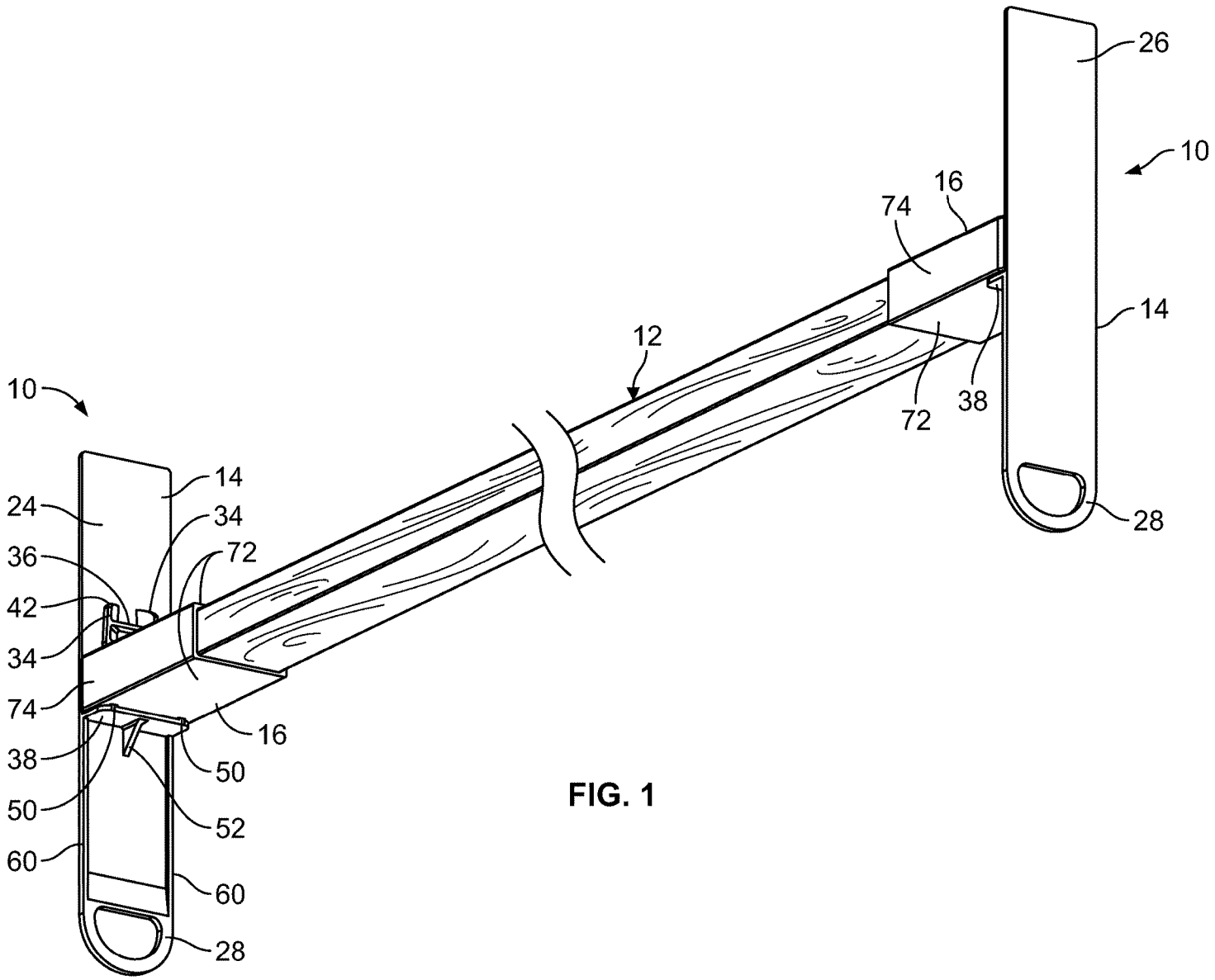
FIG. 1 is a perspective view of a pair of cargo restraint assemblies in accordance with an illustrated embodiment of the present disclosure and an elongate support for restraining cargo in a container.
Figure 2:
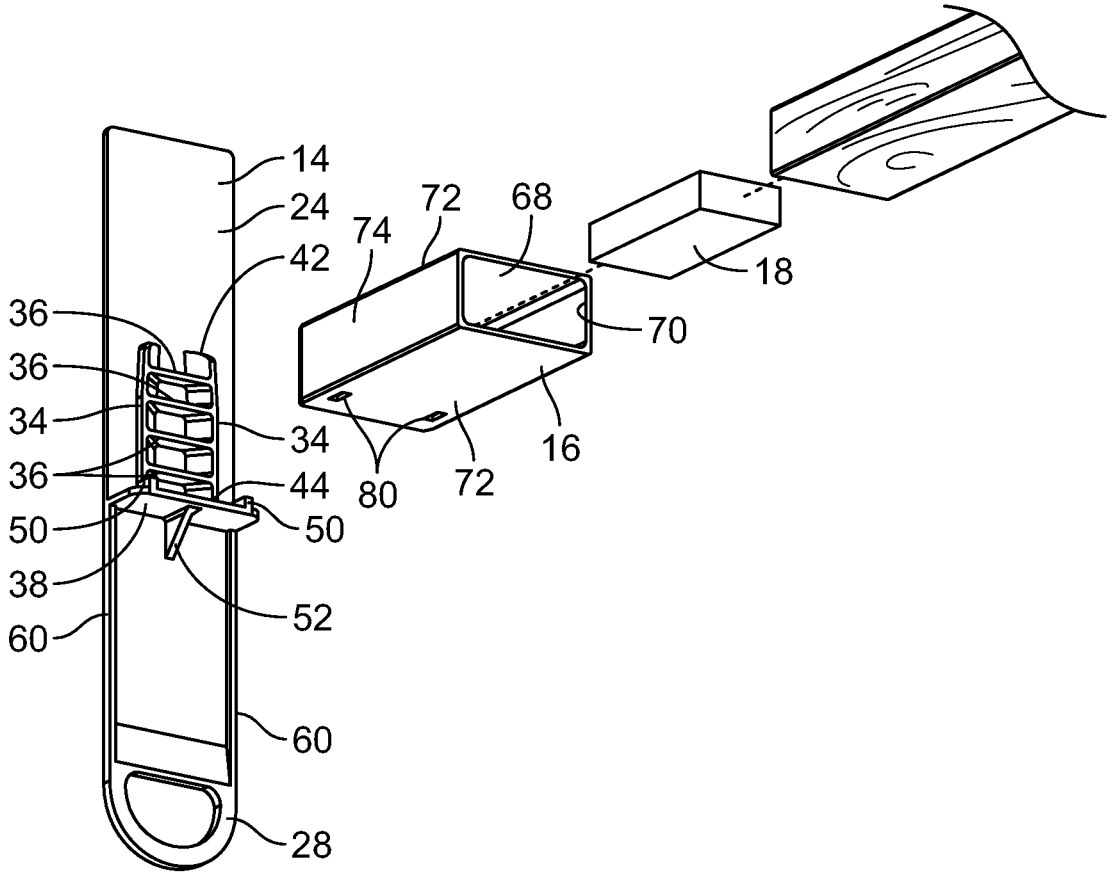
FIG. 2 is an exploded view of one of the cargo restraint assemblies and the end of the elongate support of FIG. 1.
Figure 3:
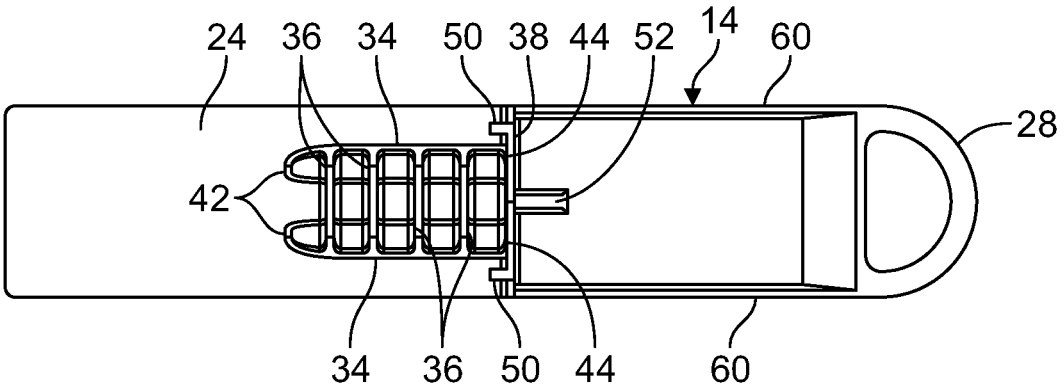
FIG. 3 is a top plan view of the base of one of the cargo restraint assemblies of FIG. 1.
Figure 4:
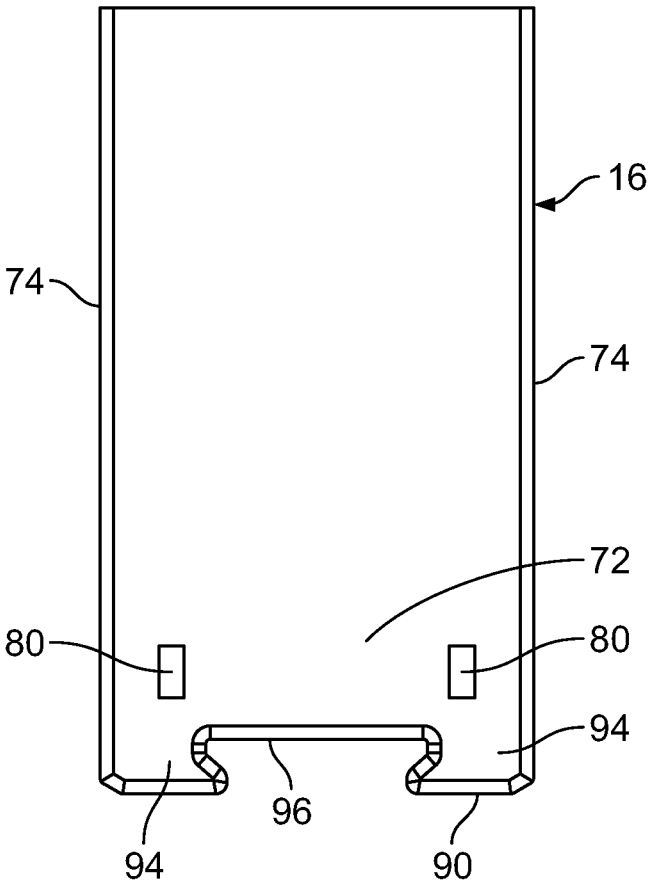
FIG. 4 is a plan view of a front or back wall of the sleeve of one of the cargo restraint assemblies of FIG. 1.
Figure 5:
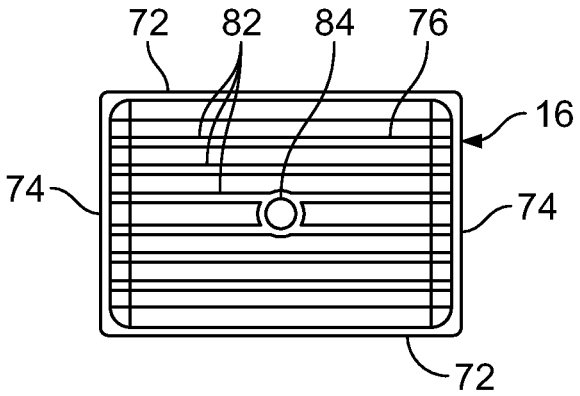
FIG. 5 is a top plan view of the sleeve of the cargo restraint assembly of FIG. 1.
Figure 6:
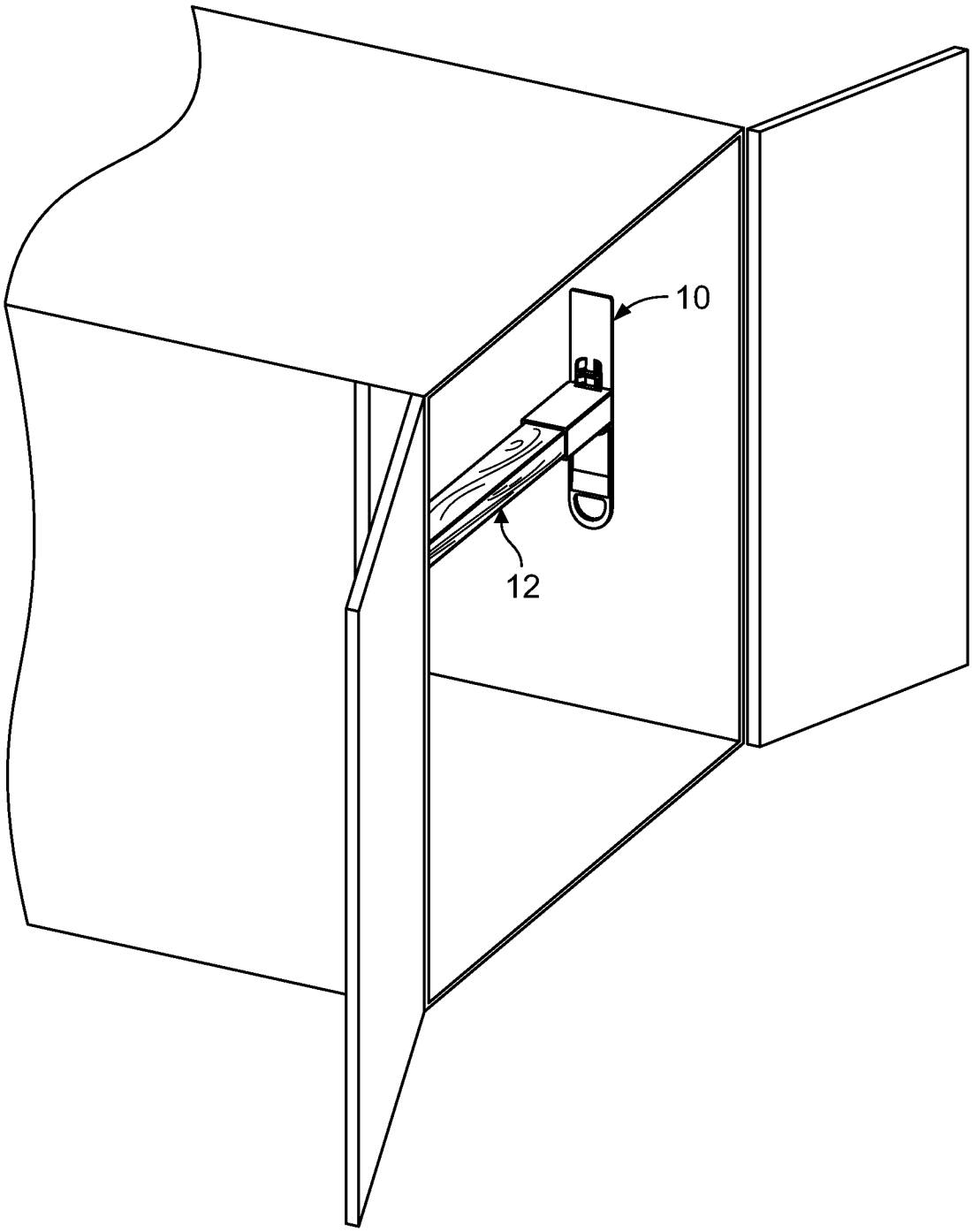
FIG. 6 is a partial view of a shipping container and the cargo restraint assemblies and elongate support of FIG. 1 for restraining cargo in a shipping container in accordance with an illustrated embodiment of the present disclosure.

FIGS. 1-7 illustrate a pair of cargo restraint assemblies 10 and a support 12 for restraining cargo in a shipping container, such as, for example, any type of trailer, truck, railcar, ship or aircraft or other shipping vessel. Each cargo restraint assembly 10 includes a base 14, a sleeve 16 slidably and removably engageable with the base 14, and a foam insert 18. The pair of cargo restraint assemblies 10 are used to secure the elongate support 12 in place in the container to restrain cargo in the container.

In the illustrated embodiment, the base 14 is a strip that includes a top surface 24, a bottom surface 26 and a handle 28. The top surface 24 includes engaging structure for engaging the sleeve, including a pair of spaced slide rails 34 extending along a longitudinal axis of the top surface 24, a plurality of strengthening ribs 36 interconnecting the pair of spaced slide rails 34, and a stop 38. Each of the slide rails 34 has a leading or front end 42 distal from the stop 38 and a back end 44 terminating at the stop 38. The slide rails 34 may be generally parallel to each other as they extend from the back end 44 toward the front end 42 and may taper near the front end 42 to provide camming effect during sliding engagement with the sleeve 16. The slide rails 34 may have any other configuration and size and, instead, may be in the form of a single slide rail or multi slide rails in accordance with other embodiments of the present disclosure. The top surface 24 and bottom surface 26 are oppositely facing.

The stop 38 may be a rectangular wall extending perpendicular to the longitudinal axis of the base 14 at the back end 44 of the slide rails 34. The stop 38 includes a pair of spaced stabilizers 50 engageable with the sleeve 16 as hereinafter described. Each stabilizer 50 is disposed at or near the top of the stop 38 and extends toward the front end 42. The stabilizers 50 extend from at or near the top of the stop 38 down a portion of the height of the stop 38 and have a rectangular cross section. The stabilizers 50 extend significantly less than the height of the stop 38. The stabilizers 50 may have any other configuration in accordance with other embodiments of the present disclosure. A gusset 52 extends from the stop 38 to the top surface 24 on a side opposite the back end 44 of the slide rails 34 for strengthening purposes. The top surface 24 also includes a pair of ridges 60 that extend from the stop 38 towards the handle 28 also for strengthening purposes. The stop 38 may be disposed at or near the middle of the top surface 24 along its longitudinal axis. In the illustrated embodiment, the stop 38 is disposed slightly nearer the handle 28 end of the base 14 than the other end of the base 14. The stop 38 may have any other construction and configuration in accordance with other embodiments of the present disclosure. The base 14 may have any other structure and configuration in accordance with other embodiments of the present disclosure.

The bottom surface 26 of the base 14 may include an adhesive for securing the securing surface selectively to a wall of the container. The adhesive may be in any suitable form. The adhesive may, for example, be in the form of an acrylic based or rubber based adhesive. A removable release liner may also be included. After removal of the release liner, the cargo restraint device base 14 can be pressed against one of the walls of the container. The adhesive may be instead disposed directly on the rear surface, may be in the form of a two-sided tape with a removable release liner, or may be in any other suitable form.

Figure 7:
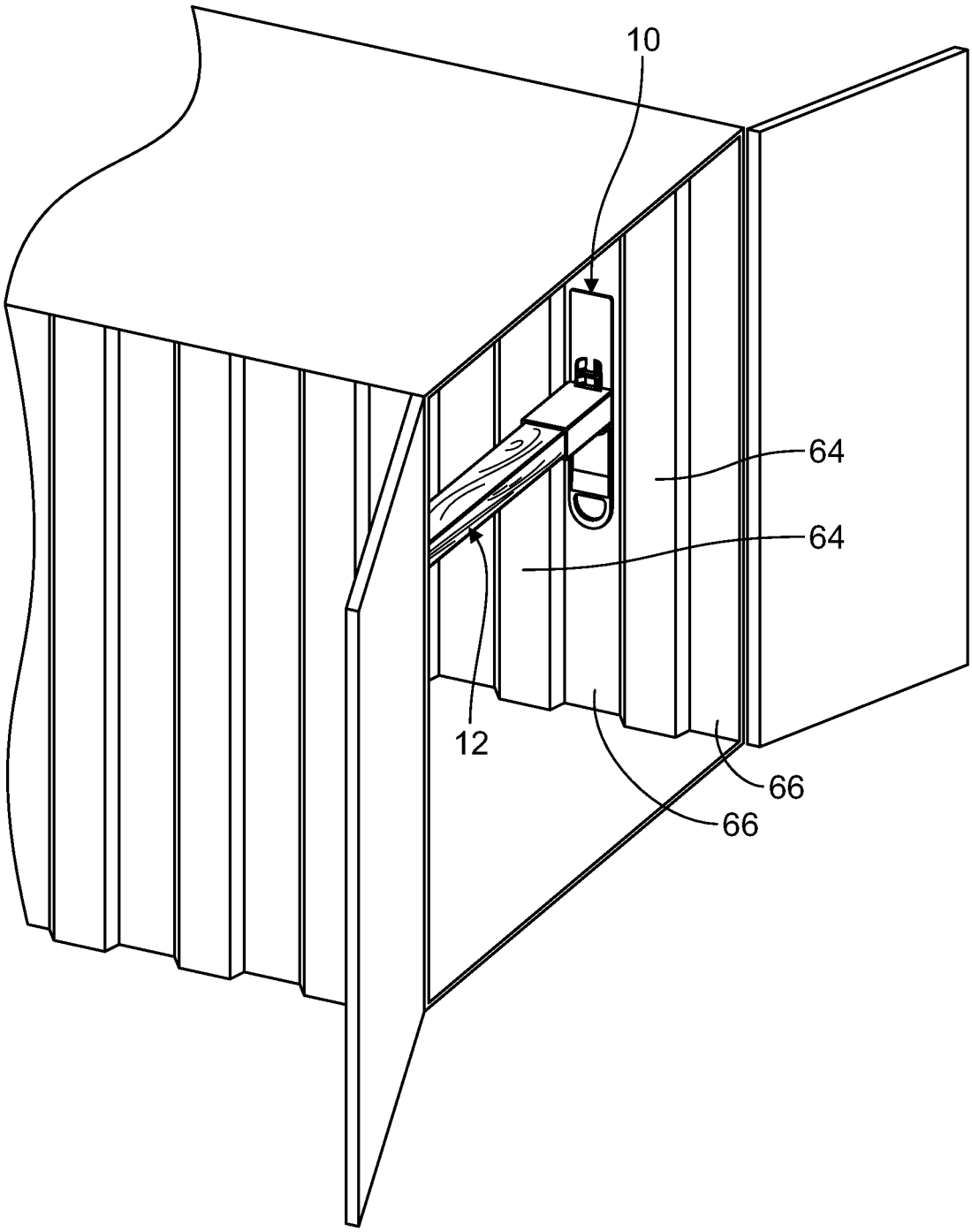
FIG. 7 is a top view of a corrugated wall of a shipping container and the cargo restraint assemblies and elongate support of FIG. 1 for restraining cargo in a shipping container in accordance with an illustrated embodiment of the present disclosure.

The base 14 may be secured to a flat wall of a container having flat walls (see, e.g., FIG. 7). The base 14 also may be secured to a corrugated wall of a container having corrugated walls (see, e.g., FIG. 8). If the shipping container has corrugated walls, the base 14 strip may be secured to either one of the peaks 64 or one of the troughs 66 of the corrugated wall. The corrugated walls may, for example, be the type associated with containers used by rail owned or associated carriers such as, for example, Norfolk Southern, Union Pacific, CSX, BNSF, CN, or CP, or freight companies such as, for example, JB Hunt, Schneider National, Hub Group, XPO Logistics, Swift Transportation, Werner, Knight Transportation, C.H. Robinson or APL Logistics. The corrugations may have any other suitable configurations. The illustrated sleeve 16 defines a cavity 68 and a top opening 70 leading to the cavity 68, which are sized and configured to receive a wood 2×3. The sleeve 16 instead may be sized and configured to a wood 2×4 or 4×4 or any other elongate support. The sleeve 16 includes two opposed walls 72, two opposed walls 74 and a floor 76. Each of the opposed walls 72 defines a pair of openings 80 for engaging the stabilizers 50 and thus each wall 72 can selectively be a front wall or a back wall to further simplify installation. The openings 80 and the stabilizers 50 are configured to facilitate receipt of the stabilizers by the openings. Although only one of the walls 72 is engaged with the stabilizers 50, each wall 72 includes the pair of openings 80 so that the installer can selectively engage either wall 72 to the stabilizers 50 without having to identify a rear wall. The floor 76 includes a plurality of ribs 82 and defines a hole 84. The bottom of the sleeve includes a plurality of strengthening ribs (not shown).

The illustrated sleeve 16 includes a bottom 90 with engaging structure for engaging the engaging structure of the base, including two feet portions 94 that define a dovetail slot 96 for slidingly receiving the slide rails 34. During engagement of the base 14 and sleeve 16, the feet portions 94 straddle the sliding rails 34 of the base and engage the top surface 24 of the base 14. The dovetail slot 96 extends from one of the walls 72 to the other wall 72. The dovetail slot 96 may be in any other suitable configuration depending upon the structure and number of the slide rails 34 on the top surface 24 of the base 14. The bottom 26 of the feet portions 94 may include a plurality of ribs. The sleeve 16 may have any other structure and configuration in accordance with other embodiments of the present disclosure.

The foam inserts 18 are used to provide a snug fit between the elongate support 12 and the sleeves 16 to secure the elongate support within the cargo restraint assemblies 10. The foam inserts 18 also allow the cargo restraint assemblies 10 to be used with elongate supports 12 that are not standard sizes or in containers that are not standard sizes. For example, the foam inserts 18 can be used with 8' beams and also with beams slightly longer, or slightly shorter, and can be used with containers having standard widths but also can accommodate containers having slightly different widths. The foam inserts 18 may have one or more perforations for removing portions of the foam during installation to reduce the size of the foam insert received by the sleeve 16. The foam inserts 18 may have any suitable size and shape in accordance with other embodiments of the present disclosure.

The cargo restraint assemblies 10 may be installed as described as follows or in any other suitable manner. The base 14 of one of the cargo restraint assemblies 10 is secured by the adhesive to one of the walls of the container such that its longitudinal axis is vertical and such that the slide rails 34 extend vertically upward from the back end 44 to the front end 42. The foam insert 18 is received by the cavity 68 of the sleeve 16. The sleeve 16 is engaged with the slide rails 34 by aligning the slide rails 34 and the slot 96 at the front end 42 of the slide rails 34 and sliding the sleeve 16 from the front end 42 of the slide rails 34 to the back of the slide rails 34 such that the sleeve 16 engages the stop 38 and the stabilizers 50 of one of the walls 72 are received by the openings 80 of one of the walls 72. The elongate support 12 is inserted into the cavity 68 of the sleeve 16 at that time or prior to engagement of the sleeve 16 and base 14. The stop 38 prevents the sleeve 16 from moving vertically downward and thus limits the movement of the sleeve 16 relevant to the base 14 in a longitudinally downward direction.

This process is repeated on the opposed wall of the container with a second cargo restraint assembly 10 except that the other end of the elongate support 12 will likely need to be inserted into the cavity 68 prior to engagement of the base 14 and the sleeve 16. As the sleeve 16 is engaged with the base 14, pressure is exerted on the foam inserts 18 or other resilient material in the sleeves 16. Once the elongate support 12 is secured to the pair of cargo restraint assemblies 10, it will restrain cargo.

The cargo restraint assemblies 10 can be secured to flat walls or corrugated walls as indicated above. The base 14 may also be sized, for example, such that the cargo restraint assemblies 10 can be secured to either a peak 64 or trough 66 of the corrugated walls. The walls of the container may be the inner walls of the container or any other structure in or associated with the container.

After use, the cargo restraint assemblies 10 can be removed in any suitable manner and without tools such as hammers or sharp objects. For example, during removal of either or both of the cargo restraint assemblies 10, the elongate support 12 can remain in the cavity 68 of the sleeve 16 and each cargo restraint assembly 10 can be easily removed from the walls of the container by applying leverage to the elongate support 12 such that the base 14 disengages from the wall of the container. The slide rails 34 and ribs 36 may be designed with sufficiently rigidity to maintain the engagement of the sleeve 16 and base 14 during the application of the leverage.

Alternatively, the elongate support 12 can be disengaged from the cargo restraint assemblies 10 by sliding one or both of the sleeves 16 upward relative to the stop 38 until the elongate support can be removed. The bases 14 can then be separated from the wall of the container in any suitable manner.

The base 14 can be used with different sleeves 16 to accommodate different size elongate supports 12. For example, sleeves 16 can be selected depending upon the size of the elongate support, e.g., 2×3 or 2×4. The cargo restraint assembly 10 in accordance with the present disclosure provides ease of assembly and ease of removal. It also can be used on flat container walls or corrugated container walls.

Figure 8:
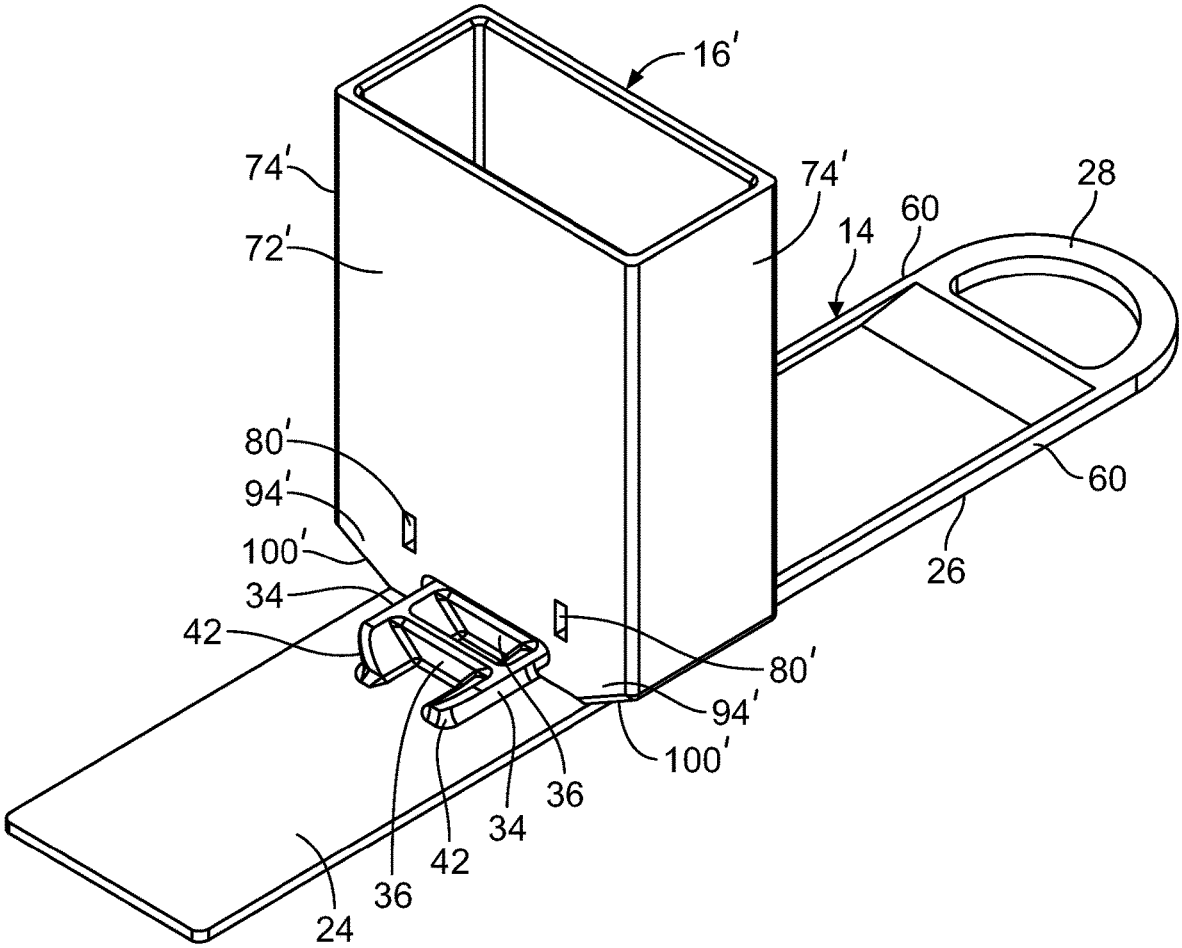
FIG. 8 is a perspective view of a cargo restraint assembly in accordance with another embodiment of the present disclosure.

FIG. 8 illustrates a sleeve 16' that is sized to receive a wider elongate support, such as a 2×4, and has a width that is greater than the width of the base 14. The illustrated sleeve 16' is constructed substantially identical to the sleeve 16 except that each of the feet 94' includes walls 100 and the walls 74' do not extend the full height of the sleeve 16'. Such structure defines clearances or other voids at the base of the feet 94' for accommodating corrugated walls. The sleeve 16' can also be used with flat walls. The sleeve 16' is slidably engageable with the base 14 as set forth above in connection with the sleeve 16.

Figure 9:
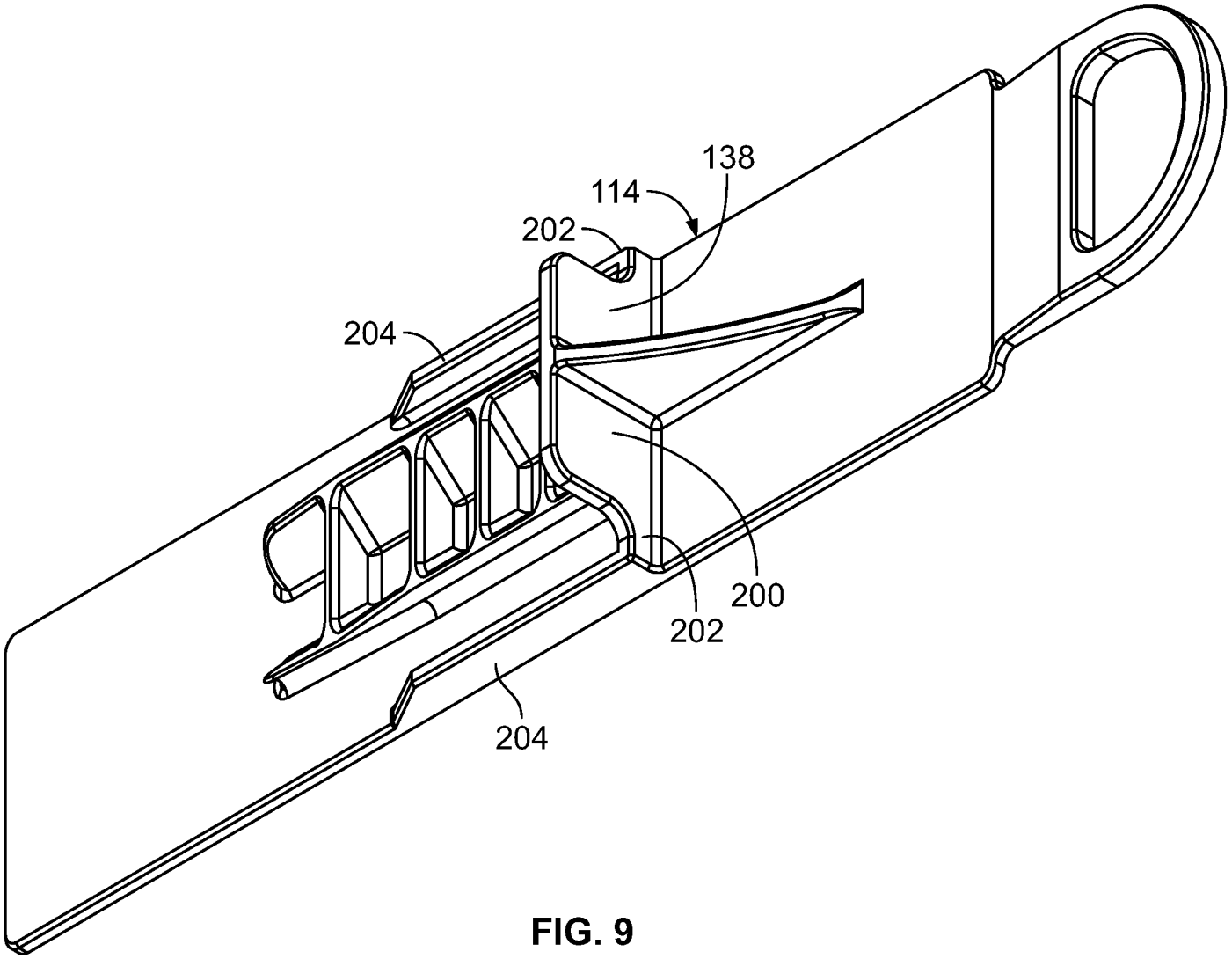
FIG. 9 is a perspective view of a base of a cargo restraint assembly in accordance with another embodiment of the present disclosure.
Figure 10:
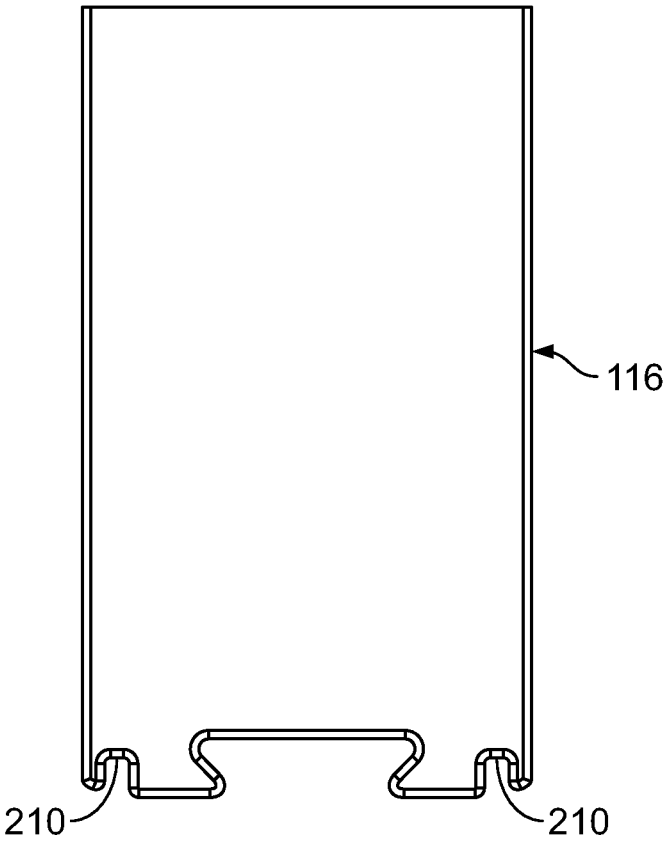
FIG. 10 is a side plan view of a sleeve of the cargo restraint assembly of FIG. 9.
Figure 11:
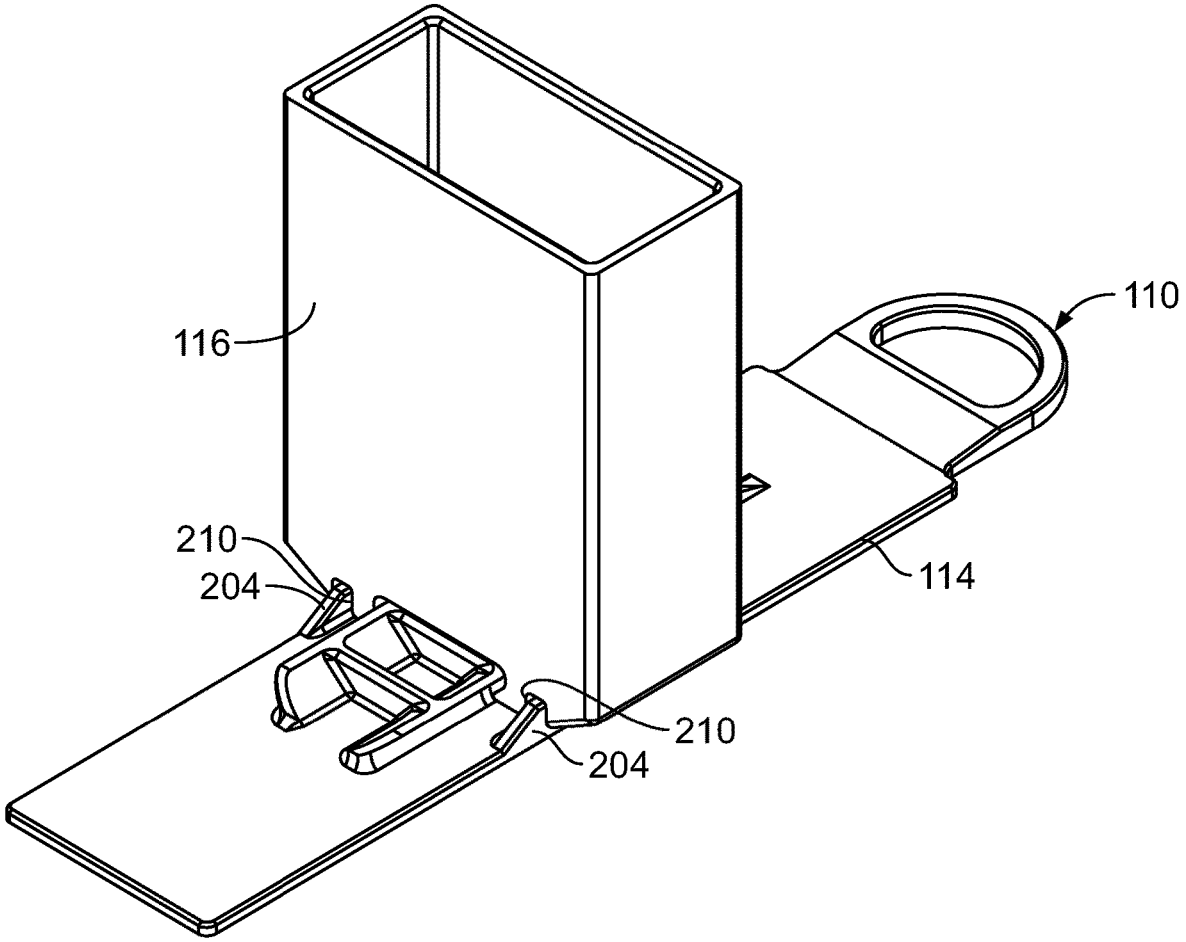
FIG. 11 is a perspective of the cargo restraint assembly of FIGS. 9 and 10.
Figure 12:
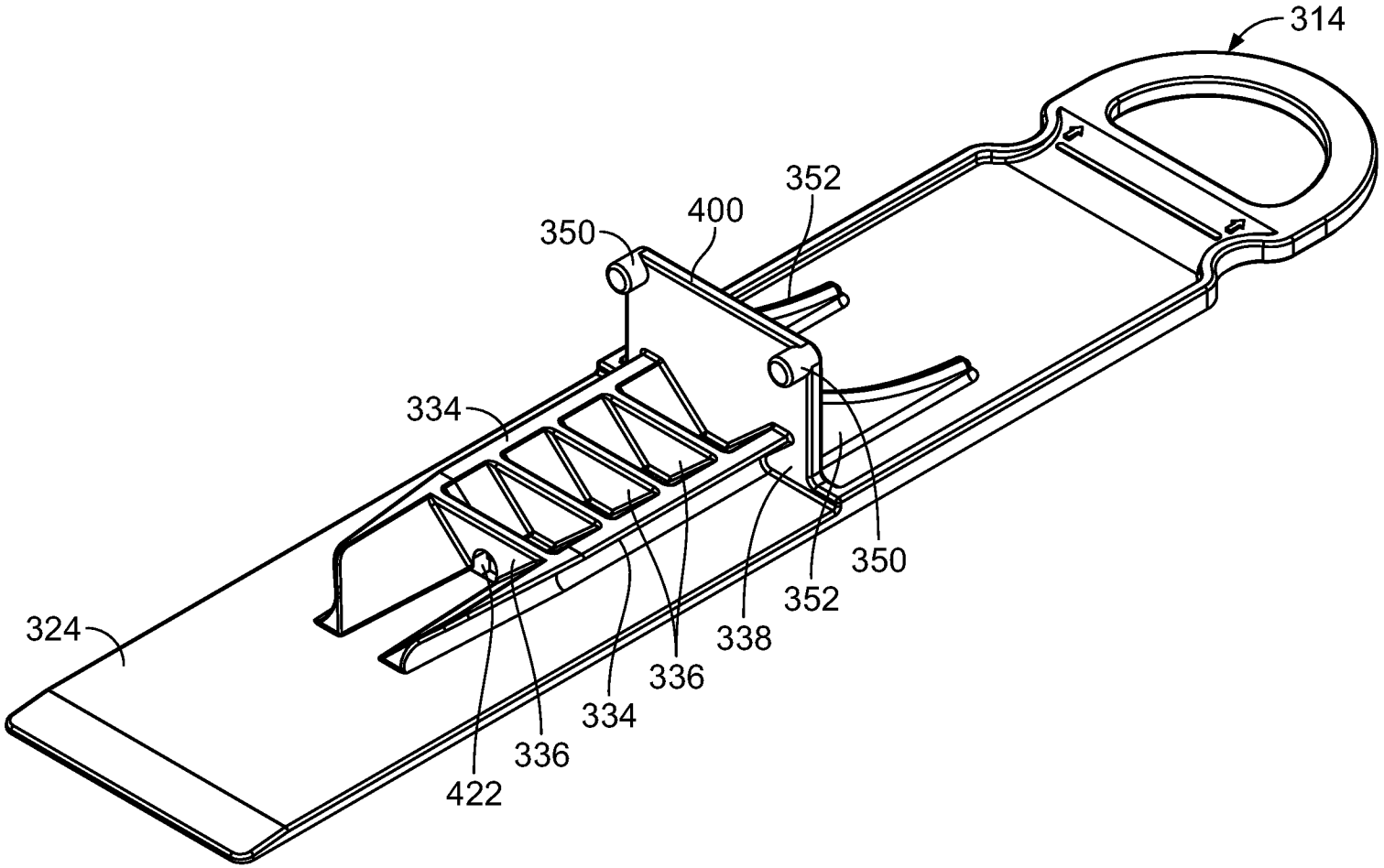
FIG. 12 is a perspective view of a base of a cargo restraint assembly in accordance with another embodiment of the present disclosure.
Figure 13:
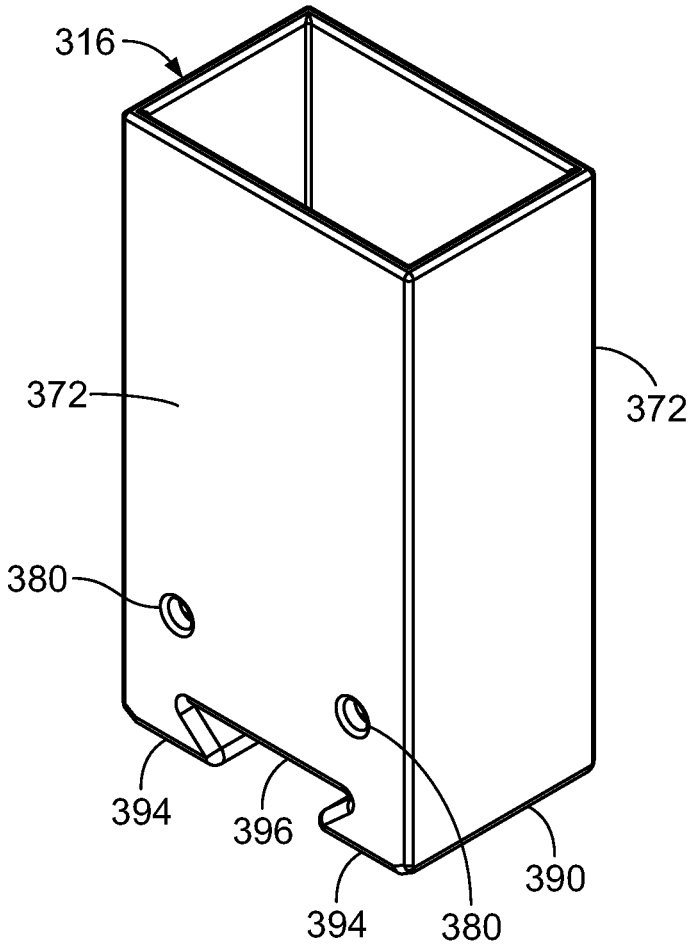
FIG. 13 is a side view of a sleeve of the cargo restraint assembly engageable with the base of FIG. 12.
Figure 14:
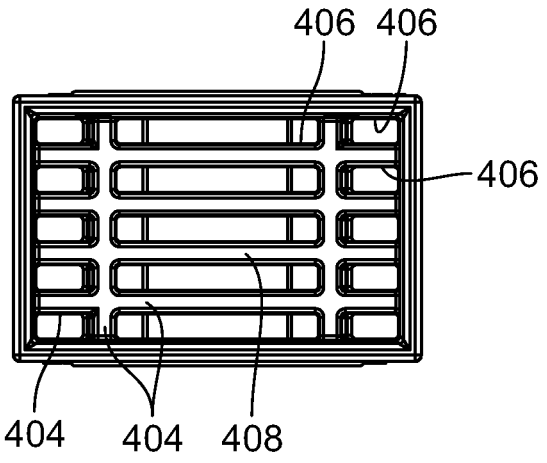
FIG. 14 is a top view of the sleeve of FIG. 13.
Figure 15:
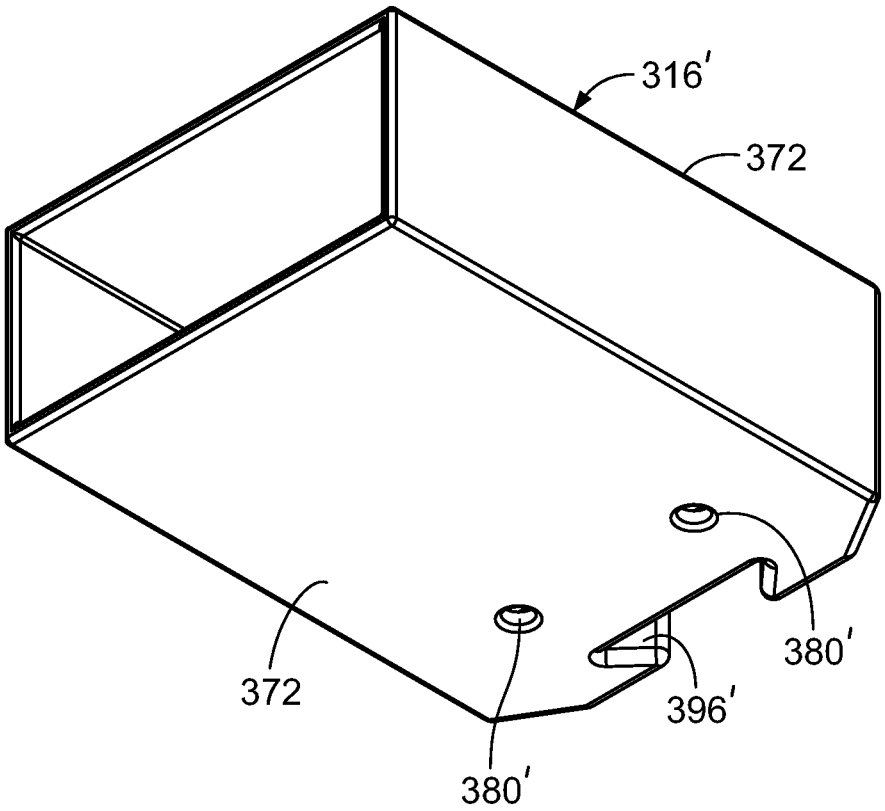
FIG. 15 is a perspective view of another sleeve of the cargo restraint assembly engageable with the base of FIG. 12.
Figure 16:
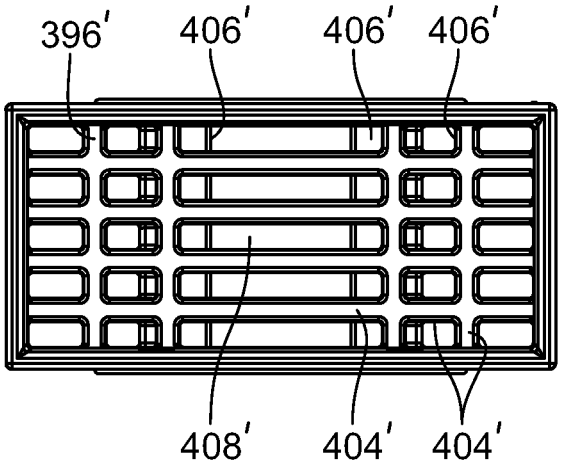
FIG. 16 is a top view of the sleeve of FIG. 15.

FIGS. 9-11 illustrate a base 114 and sleeve 116 of a cargo restraint assembly 110 in accordance with another embodiment of the present disclosure. The base 114 includes a stop 138 that includes a center wall 200 and a pair of side walls 202 disposed about the center wall. The center wall 200 extends higher than the side walls 202. The corners of the center wall 200 may be rounded. A pair of lips 204 extends from the side walls 202 for engaging the base of the cargo restraint assembly. The sleeve 116 includes a pair of channels 210 for slidably engaging the lips 204. The stabilizers 50 of FIGS. 1-8 may be eliminated in this and other embodiments. The bottom of the sleeve may include a plurality of strengthening ribs. Similar to the embodiment of FIG. 8, if the sleeve 116 is sized to receive a wider elongate support, such as a 2×4, having a width that is greater than the width of the base 114, the sleeve may include feet that define clearances or other voids at the base of the feet for accommodating corrugated walls. The feet also may define the channels for slidably engaging the lips 204.

FIGS. 12-16 illustrate a base 314 and a sleeve 316 of a cargo restraint assembly in accordance with another embodiment of the present disclosure. The base 314 includes a stop 338 that includes a center wall 400 and a pair of stabilizers 350 in the form of pegs. The center wall 400 has a width less than the width of the base 314. The corners of the center wall 400 may be rounded.

The top surface 324 of base 314 includes engaging structure for engaging the sleeve 316, including a pair of spaced slide rails 334 extending along a longitudinal axis of the top surface 324. A plurality of strengthening ribs 336 may interconnect the pair of spaced slide rails 334. A pair of gussets 352 extends from the stop 338 to the top surface 324 on a side opposite the slide rails 334 for strengthening purposes.

The illustrated sleeve 316 includes a bottom 390 with engaging structure for engaging the engaging structure of the base, including two feet portions 394 that define a dovetail slot 396 for slidingly receiving the slide rails 334. During engagement of the base 314 and sleeve 316, the feet portions 394 straddle the sliding rails 334 of the base and engage the top surface 324 of the base 314. The dovetail slot 396 may be in any other suitable configuration depending upon the structure and number of the slide rails 334 on the top surface 324 of the base 314 or the configuration of the engaging structure of the base.

The sleeve 316 may define a pair of openings 380 on at least one of the walls 372 of the sleeve for engaging the stabilizers 350. Each wall 372 can selectively be a front wall or a back wall to further simplify installation if the openings 380 are defined in both walls 372. The bottom 390 of the sleeve 316 defines a dovetail slot 396. The bottom 390 may include a plurality of struts 404 defining a plurality of openings 406 to form a grate 408 to reduce manufacturing costs and weight. Sleeve 316 may be sized and configured to receive a wood 2×3.

Similar to above embodiments, an alternative sleeve 316' is sized to receive a wider elongate support, such as a 2×4, and has a width that is greater than the width of the base 314. The sleeve 316' may include feet 394' that define clearances or other voids at the base of the feet for accommodating corrugated walls.

The bottom 390' of the sleeve 316' may include a plurality of struts 404' defining a plurality of openings 406' to form a grate 408' to reduce manufacturing costs and weight. The sleeve 316' may be sized and configured to receive elongated supports of any other size, and may have any other structure and configuration in accordance with other embodiments of the present disclosure.

Figure 17:
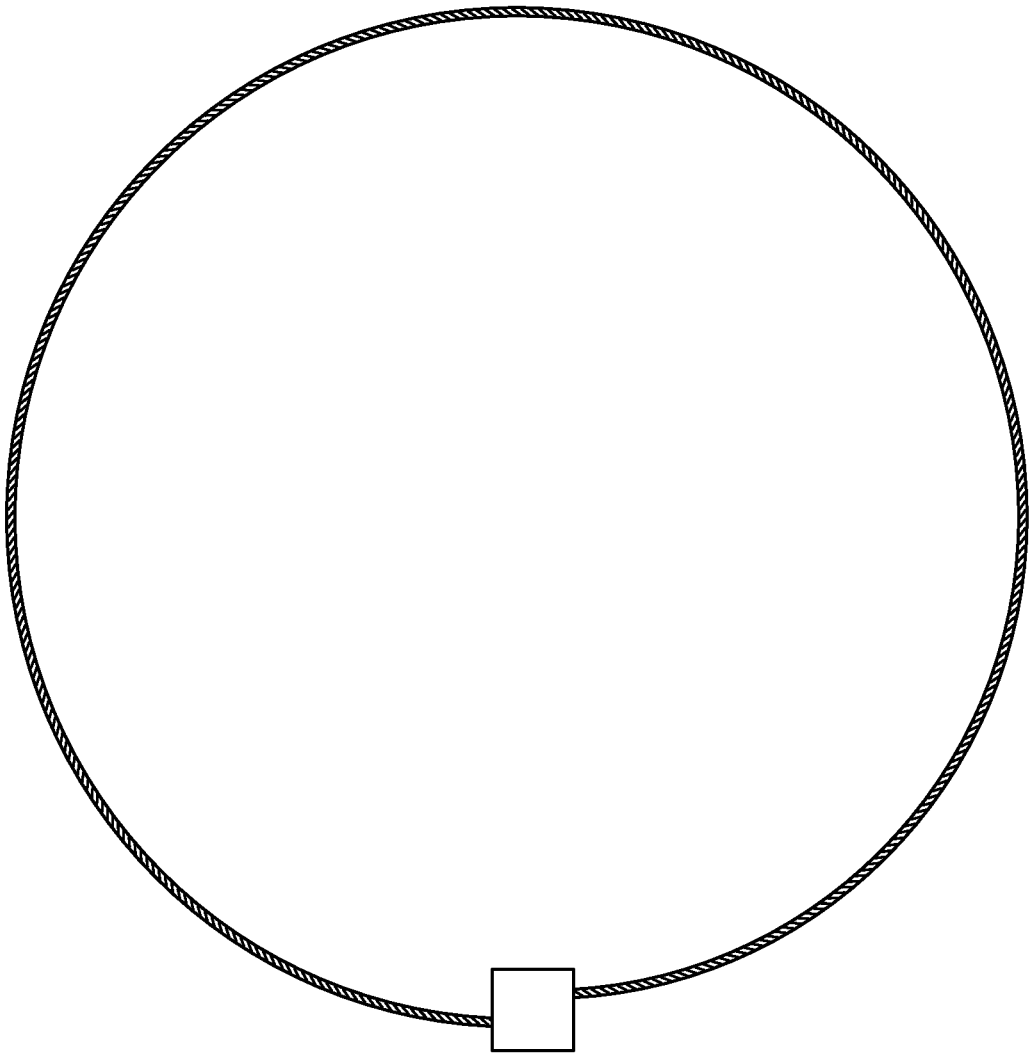
FIG. 17 is a side view of a tamper resistant cord that may be included with the cargo restraint assembly of FIGS. 12-16.

The cargo restraint assembly illustrated in FIGS. 12-16 include tamper evident structure for evidencing any tampering of the assembly during transport. For example, the illustrated base 314 includes a cable seal 420 (see FIG. 17) that is received by a hole 422 defined by one of the ribs 336. The cable seal 420 may extend around or otherwise engage the sleeve 316 to detect tampering during use of the cargo restraint assembly. The cargo restraint assembly of FIGS. 12-16 may also include a foam insert as described above in connection with other embodiments.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as having or implying limitation of the disclosure to those embodiments. There is a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. An assembly for engaging an elongate support for restraining cargo in a container having a wall, the assembly comprising:

a base strip securable to the wall having a longitudinal axis and including a top surface having first engaging structure extending along the longitudinal axis; and a sleeve defining a cavity for receiving an end of the elongated support, and including a top defining an opening of the cavity and a bottom having second engaging structure removably engageable with the first engaging structure for removably engaging the sleeve and the base strip;

wherein the first engaging structure comprises a first slide rail extending along the longitudinal axis and the second engaging structure defines a slot for slidingly engaging the first slide rail.

2. The assembly of claim 1 wherein the first engaging structure includes a stop adjacent the first slide rail for limiting movement of the sleeve in a longitudinal direction along the longitudinal axis of the base strip.

3. The assembly of claim 2 wherein the base strip further includes a pair of lips extending from the stop and the bottom of the sleeve defines a pair of channels for slidably engaging the pair of lips.

4. The assembly of claim 2 wherein the sleeve includes a wall defining an opening and the stop includes a stabilizer receivable by the opening to removably engage the sleeve and the stop.

5. The assembly of claim 4 wherein the stabilizer is a peg.

6. The assembly of claim 1 wherein the first engaging structure further includes a second slide rail extending along the longitudinal axis slidably receivable by the slot, the first and second slide rails being spaced from each other.

7. The assembly of claim 6 further including a plurality of ribs interconnecting the first and second slide rails.

8. The assembly of claim 6 wherein the base strip includes a first lateral edge adjacent the first slide rail and a second lateral edge adjacent the second slide rail, the first slide rail extending from the top surface at an angle towards the first lateral edge and the second slide rail extending from the top surface at an angle towards the second lateral edge.

9. The assembly of claim 8 wherein the slot is a dovetail slot that slidingly engages the first and second slide rails.

10. The assembly of claim 6 wherein a leading end of the first slide rail is tapered and a leading end of the second slide rail is tapered.

11. The assembly of claim 6 wherein the first engaging structure includes a stop disposed at a rear end of the first slide rail and a rear end of the second slide rail for limiting the movement of the sleeve in a longitudinal direction along the longitudinal axis.

12. The assembly of claim 11 wherein a leading end of the first slide rail is tapered and a leading end of the second slide rail is tapered.

13. The assembly of claim 11 wherein the sleeve includes a wall defining a pair of openings and the stop includes a pair of stabilizers receivable by the openings to removably engage the sleeve and the stop.

14. The assembly of claim 12 wherein the stabilizers comprise pegs.

15. The assembly of claim 11 wherein the sleeve includes a pair of opposed walls, each wall defining a pair of openings, and the stop includes a pair of stabilizers selectively receivable by one of the pairs of openings.

16. The assembly of claim 11 further including at least one gusset interconnected with the stop and the top surface.

17. The assembly of claim 1 wherein the sleeve includes a bottom defining a plurality of openings.

18. An assembly for engaging an elongate support for restraining cargo in a container having a wall, the assembly comprising:

a base strip securable to the wall having a longitudinal axis and including a top surface having a first slide rail extending along the longitudinal axis;

a sleeve defining a cavity for receiving an end of the elongated support, and including a top defining an opening of the cavity and a bottom defining a slot for slidingly engaging the first slide rail and for removably engaging the sleeve and the base strip.

19. The assembly of claim 18 further including a second slide rail extending along the longitudinal axis, the first and second slide rails being spaced from each other, the slot slidingly engageable with the second slide rail for removably engaging the sleeve and the base strip.

* * * * *